US007737311B2

(12) United States Patent
Cracknell et al.

(10) Patent No.: US 7,737,311 B2
(45) Date of Patent: Jun. 15, 2010

(54) FUEL COMPOSITIONS

(75) Inventors: Roger Francis Cracknell, Chester (GB); Trevor Stephenson, Chester (GB)

(73) Assignee: Shell Oil Company, Houston, TX (US)

( * ) Notice: Subject to any disclaimer, the term of this patent is extended or adjusted under 35 U.S.C. 154(b) by 812 days.

(21) Appl. No.: 10/934,622

(22) Filed: Sep. 3, 2004

(65) Prior Publication Data

US 2005/0277794 A1 Dec. 15, 2005

(30) Foreign Application Priority Data

Sep. 3, 2003 (EP) ..... 03255486

(51) Int. Cl.

| | |
|---|---|
| ***C10L 1/16*** | (2006.01) |
| ***C10L 1/00*** | (2006.01) |
| ***C10L 1/04*** | (2006.01) |
| ***C07C 27/00*** | (2006.01) |
| ***C07C 27/26*** | (2006.01) |
| ***C10L 3/00*** | (2006.01) |

(52) U.S. Cl. ..... 585/14; 208/14; 208/15; 208/16; 208/17; 518/702; 518/706; 518/726; 48/197 FM; 60/274; 60/295

(58) Field of Classification Search ..... 518/702, 518/706, 726; 585/14; 208/14, 15, 16, 17; 48/197 FM; 60/274, 295

See application file for complete search history.

(56) References Cited

U.S. PATENT DOCUMENTS

| | | | | |
|---|---|---|---|---|
| 2,917,375 | A | 12/1959 | Hudson | 44/62 |
| 3,923,958 | A | 12/1975 | Turnbo et al. | 423/245 |
| 4,125,566 | A | 11/1978 | Trin Dine et al. | 260/676 |
| 4,208,190 | A | 6/1980 | Malec | 44/53 |
| 4,478,955 | A | 10/1984 | Pesa et al. | 518/713 |
| 4,605,680 | A * | 8/1986 | Beuther et al. | 518/715 |
| 5,192,336 | A * | 3/1993 | Grewal | 44/418 |
| 5,556,574 | A | 9/1996 | Rivas et al. | |
| 5,603,864 | A | 2/1997 | Silva et al. | |
| 5,733,346 | A | 3/1998 | Davies et al. | 44/320 |
| 5,814,109 | A | 9/1998 | Cook et al. | 44/300 |
| H1849 | H * | 5/2000 | Fourie et al. | 429/17 |
| 6,162,956 | A | 12/2000 | Berlowitz et al. | |
| 6,180,842 | B1 | 1/2001 | Berlowitz et al. | |
| 6,199,372 | B1 * | 3/2001 | Wakamoto | 60/274 |
| 6,204,426 | B1 | 3/2001 | Miller et al. | 585/739 |
| 6,274,029 | B1 | 8/2001 | Wittenbrink et al. | |
| 6,296,757 | B1 | 10/2001 | Wittenbrink et al. | 208/15 |
| 6,297,413 | B1 | 10/2001 | Colson et al. | 585/3 |
| 6,369,286 | B1 | 4/2002 | O'Rear | 585/644 |
| 6,458,173 | B1 * | 10/2002 | Lin | 44/389 |
| 6,458,265 | B1 | 10/2002 | Miller | 208/137 |
| 6,607,566 | B1 * | 8/2003 | Coleman et al. | 44/301 |
| 6,607,568 | B2 | 8/2003 | Wittenbrink et al. | |
| 6,629,407 | B2 * | 10/2003 | Roos et al. | 60/274 |
| 6,663,767 | B1 | 12/2003 | Berlowitz et al. | 208/15 |
| 6,723,889 | B2 | 4/2004 | Miller et al. | |
| 6,755,961 | B1 | 6/2004 | Berlowitz et al. | 208/15 |
| 6,776,897 | B2 | 8/2004 | Bacha et al. | |
| 6,786,938 | B1 * | 9/2004 | Cemenska et al. | 44/301 |
| 6,860,909 | B2 | 3/2005 | Berlowitz et al. | 44/436 |
| 6,959,542 | B2 * | 11/2005 | Taylor et al. | 60/295 |
| 6,979,395 | B2 | 12/2005 | Pace et al. | 208/15 |
| 7,150,823 | B2 * | 12/2006 | Mayer et al. | 208/251 R |
| 7,179,364 | B2 | 2/2007 | O'Rear et al. | 208/15 |
| 7,645,305 | B1 * | 1/2010 | Coleman et al. | 44/301 |
| 2001/0015180 | A1 * | 8/2001 | Tinney | 123/1 A |
| 2002/0020107 | A1 | 2/2002 | Bailey et al. | |
| 2003/0000145 | A1 * | 1/2003 | Salemi et al. | 48/199 FM |
| 2003/0036572 | A1 * | 2/2003 | Shiroto et al. | 518/704 |
| 2003/0084876 | A1 * | 5/2003 | Stanglmaier | 123/431 |
| 2003/0118960 | A1 * | 6/2003 | Balmer-Millar et al. | 431/146 |
| 2003/0140622 | A1 * | 7/2003 | Taylor et al. | 60/295 |
| 2003/0163946 | A1 * | 9/2003 | Berlowitz et al. | 44/301 |
| 2004/0074452 | A1 * | 4/2004 | Guinther et al. | 123/1 A |
| 2005/0086854 | A1 * | 4/2005 | Millington et al. | 44/385 |

FOREIGN PATENT DOCUMENTS

| | | |
|---|---|---|
| AU | 2004269169 B2 | 3/2005 |
| EP | 0147240 | 7/1985 |

(Continued)

OTHER PUBLICATIONS

"The Shell Middle Distillate Synthesis Process", paper delivered at the 5th Synfuels Worldwide Symposium, Washington, DC, Nov. 1985.

(Continued)

*Primary Examiner*—Walter D Griffin
*Assistant Examiner*—Huy-Tram Nguyen

(57) ABSTRACT

Use of a Fischer-Tropsch derived fuel in a fuel composition is disclosed, for the purpose of reducing catalyst degradation in a catalytically driven or catalyst containing system which is running on, or is to be run on, the composition or its products, wherein the Fischer-Tropsch derived fuel is used to reduce the level of silicon in the fuel composition, such as by reducing the concentration of silicon-containing antifoaming additive (s) in the fuel composition. It may also be used to reduce loss of efficiency of fuel atomization and/or combustion, and/or to reduce build up of silicon deposits, in a fuel consuming system which is running on, or is to be run on, the fuel composition.

30 Claims, No Drawings

FOREIGN PATENT DOCUMENTS

| | | | |
|---|---|---|---|
| EP | 0147873 | | 7/1985 |
| EP | 0482253 | | 4/1992 |
| EP | 0557516 | | 9/1993 |
| EP | 0583836 | | 2/1994 |
| EP | 0613938 | | 9/1994 |
| EP | 0875520 | | 11/1998 |
| EP | 1101813 | | 5/2001 |
| EP | 1188811 | | 3/2002 |
| GB | 0960493 | | 8/1960 |
| GB | 2077289 | | 6/1980 |
| WO | 94/06894 | | 3/1994 |
| WO | 97/14768 | | 4/1997 |
| WO | 97/14769 | | 4/1997 |
| WO | 99/13028 | A1 | 9/1998 |
| WO | 98/42808 | | 10/1998 |
| WO | 00/11116 | | 3/2000 |
| WO | 00/11117 | | 3/2000 |
| WO | 00/20534 | | 4/2000 |
| WO | 00/20535 | | 4/2000 |
| WO | 00/60029 | | 10/2000 |
| WO | 00/61707 | | 10/2000 |
| WO | WO 01/46349 | A1 | 6/2001 |
| WO | 01/49812 | | 7/2001 |
| WO | 01/60955 | | 8/2001 |
| WO | 01/83406 | | 11/2001 |
| WO | 01/83641 | | 11/2001 |
| WO | 01/83647 | | 11/2001 |
| WO | 01/83648 | | 11/2001 |
| WO | WO 01/83406 | A2 | 11/2001 |
| WO | 02/48293 | | 6/2002 |
| WO | 03/087273 | | 10/2003 |
| WO | 03/091364 | | 11/2003 |

OTHER PUBLICATIONS

"The Shell middle distillate synthesis process" by Maarten Van der Burgt, Jaap van Klinken, Tjong Sie, Nov. 1989.

* cited by examiner

FUEL COMPOSITIONS

FIELD OF THE INVENTION

The present invention relates to fuel compositions, their preparation and their uses.

BACKGROUND OF THE INVENTION

Many fuel consuming systems are catalytically driven. Such systems include fuel reformers for instance for the oxidation or partial oxidation of fuels.

Other catalytic systems which come into contact with fuels or with the by-products of fuel consumption (in particular fuel combustion) include the exhaust aftertreatment systems of automotive vehicles.

In such systems, the content of the fuel may influence catalyst performance, particularly if the fuel contains agents capable of acting, in the context, as catalyst "poisons". In particular in the case of an exhaust aftertreatment system, however, the fuel and fuel by-products passing through it may contain all manner of additives which are included in the fuel for purposes unrelated to the operation of the exhaust system.

For example, fuel compositions for use in typical current diesel (compression ignition) engines tend to include one or more additives to enhance their performance and properties. Such additives include antifoaming agents to reduce foaming during engine refueling. The antifoaming agents typically preferred for use in diesel fuels are silicone based.

Silicon, which may be contained in fuel additives, can cause degradation of catalyst efficiency when present in the fuel feed to a catalytically driven fuel processor. It might also therefore be expected to compromise, to at least a degree, catalyst efficiency in other catalytically driven systems, including the exhaust aftertreatment systems of diesel vehicles running on similarly additivated fuels.

Moreover, silicon deposits have also been found in the deposits which accumulate in the fuel injectors of diesel engines. High levels of such deposits can impair fuel atomization and combustion and hence overall engine efficiency.

SUMMARY OF THE INVENTION

Accordingly, in one embodiment of the invention, a fuel composition is provided, comprising a Fischer-Tropsch derived fuel wherein the fuel composition contains 1000 ppbw or less of silicon.

In another embodiment of the invention, a method of operating a fuel consuming system, which method comprising introducing into the system a fuel composition containing a Fischer-Tropsch derived fuel containing 1000 ppbw or less of silicon.

DETAILED DESCRIPTION OF THE INVENTION

The present inventors have identified a desirability for fuel compositions, including automotive fuel compositions such as diesel fuels, which have a reduced or no detrimental effect on catalyst efficiency in catalytically driven systems with which they come into contact, and desirably also have a reduced or no detrimental effect on fuel atomization or combustion performance in fuel combustion systems they are used to power.

It has now been found that certain fuel components can be used to replace, entirely or at least partially, fuel additives such as in particular silicon containing antifoaming additives, the components themselves having antifoaming properties both alone and when blended with other fuel components. They may therefore be used to reduce silicon levels in fuels and fuel compositions.

According to its first aspect the present invention provides use of a Fischer-Tropsch derived fuel in a fuel composition, for the purpose of reducing catalyst degradation in a catalytically driven or catalyst containing system which is running on, or is to be run on, the fuel composition or its products, wherein the Fischer-Tropsch derived fuel is used to reduce the level of silicon in the fuel composition.

The system may be a fuel consuming (which term includes fuel powered) system. For example it may be a fuel processing system which catalytically modifies (for instance by completely or partially oxidizing, cracking, isomerizing or reacting with other species) a fuel or a fuel-derived product such as a combustion product. In particular it may be or comprise a fuel reformer, for instance of the type which oxidizes fuel and can be used to produce "syngas" (a mixture of carbon monoxide and hydrogen) and which may be combined with other downstream processors such as a shift reactor and suitable selective oxidation catalyst to generate hydrogen for example for use in fuel cell vehicles.

The system may be a system which acts on the products of the fuel composition after it has been processed in some way for instance by combustion. Such systems include exhaust aftertreatment systems associated with combustion engines, in particular internal combustion engines such as diesel engines, in which catalysts act to modify the combustion by-products of the fuel or composition on which the engine runs. Catalytically driven components of exhaust aftertreatment systems include for example oxidation systems and particulate traps.

The catalyst in the system may be of any type, for example an oxidation catalyst, or a de-NOx catalyst of the type used in heavy duty vehicle exhaust aftertreatment systems. It may in particular be or include a platinum group metal.

The Fischer-Tropsch derived fuel may be used at least partly in place of fuel additive(s), in particular silicon containing (eg, silicone based) antifoaming additive(s), which would otherwise have been present in the fuel or composition, suitably by performing at least part of the usual and/or intended function of those additives.

In the context of the present invention, "use" of a Fischer-Tropsch derived fuel in a fuel composition means incorporating the Fischer-Tropsch fuel into the composition, typically as a blend (ie, a physical mixture) with one or more other fuel components and/or fuel additives, conveniently before the composition is introduced into a system which is to be run on the fuel composition. "Use" also embraces using the Fischer-Tropsch derived fuel on its own as a fuel composition. Instead or in addition it may involve running a catalytically driven or catalyst containing system using such a fuel composition.

The terms "reduction" and "reducing" embrace reduction to zero.

Degree of catalyst degradation may be assessed by operating the catalyst containing system for a specified period of time using the relevant fuel composition as a feed stream, and measuring the change in efficiency of the catalyst between the start and the end of this running period. This in turn can be assessed with reference to the change in yield of one or more products of the system. A reduction in catalyst degradation will be manifested by a less negative change in yield (ie, a lower yield loss) over the running period.

Preferably the Fischer-Tropsch derived fuel is used in an amount sufficient to achieve, in the context of its use, a reduction in yield loss of at least 15%, more preferably at least 25%, yet more preferably at least 50%, most preferably at least 65 or 80 or 85 or 90 or 95%, even up to 99% or more and ideally 100%, of that caused over the same time period and under the same test conditions by running the same system on a non-Fischer-Tropsch derived fuel, and/or by running the system on the same fuel composition but without, or with less of (suitably with 5% v/v or less of, more suitably 1% v/v or less of), the Fischer-Tropsch derived fuel present, and/or by running the system on the same fuel composition prior to inclusion, in accordance with the present invention, of the Fischer-Tropsch derived fuel, or of a higher level of Fischer-Tropsch derived fuel(s), to reduce its silicon levels.

Preferably the Fischer-Tropsch derived fuel is used in an amount sufficient that, in the context of its use, it causes no more than a 10% reduction, ideally no more than an 8% or a 5% reduction, in catalyst efficiency (eg, in yield). Yet more preferably the amount is sufficient to achieve, in the context, no or no significant catalyst degradation.

Such changes in catalyst efficiency may be assessed over any appropriate test period, for instance 10 operating hours or more, suitably 100 or 200 or 500 operating hours or more. They may be assessed over the lifetime or expected lifetime of the system, for instance up to 5,000 operating hours for a typical passenger vehicle or up to 50,000 operating hours for a commercial vehicle or a stationary system.

Such measurements may be made by operating the system under its usual operating conditions, ideally seeking to maximize initial yield rates. The relevant running period may be one hour or more, suitably 3 or 5 hours or more, possibly up to 10 hours or more.

A reduced level of silicon may be as compared to the level of silicon which would otherwise have been incorporated into the fuel composition in order to achieve the properties and performance required and/or desired of it in the context of its intended use. This may for instance be the level of silicon which was present in the fuel composition prior to the realization that silicon levels could be reduced in the manner provided by the present invention, and/or which was present in an otherwise analogous fuel or composition intended (eg, marketed) for use in an analogous context.

As a result of using the Fischer-Tropsch derived fuel, the fuel composition preferably contains 1000 or 800 ppbw or less of silicon, more preferably 500 ppbw or less, yet more preferably 250 ppbw or less, most preferably 100 ppbw or less. It is ideally substantially free of silicon, the term "substantially free" being intended to encompass 50 ppbw or less silicon, preferably 20 or 10 ppbw or less. If possible it contains no silicon at all or at least only trace amounts such as could be attributable to environmental contamination (dust).

It has been found that a Fischer-Tropsch derived fuel may be used to itself achieve at least part of the effect normally achieved in fuel compositions by the use of antifoaming additive(s), in particular silicon containing antifoaming additive(s). The resultant composition can contain a lower level of such additives but without loss of, or without undue loss of, preferably even with an improvement in, antifoaming performance.

A lower level of an additive may be as compared to the level of that additive which would otherwise have been incorporated into the fuel composition in order to achieve the properties and performance required and/or desired of it in the context of its intended use. This may for instance be the level of the additive which was present in the fuel composition prior to the realization that a Fischer-Tropsch derived fuel could be used in the way provided by the present invention, and/or which was present in an otherwise analogous fuel composition intended (eg, marketed) for use in an analogous context, prior to increasing the amount of Fischer-Tropsch derived fuel that it contained.

Preferably the Fischer-Tropsch derived fuel is used to reduce the w/w concentration of antifoaming additive(s) in the fuel composition by at least 10%, more preferably by at least 20 or 30%, yet more preferably by at least 50 or 70 or 80 or even 90%. It may be used to replace such additives entirely, leaving a concentration of such additives in the composition of 0% w/w, ie, the fuel composition is free of such additives.

It may for instance be used to an extent that the concentration of antifoaming additives remaining in the fuel composition is 10 ppmw (parts per million by weight) or less, preferably less than 10 ppmw, more preferably 5 ppmw or less, yet more preferably less than 5 ppmw, still more preferably 4 or even 3 ppmw or less. Most preferably it may be used to replace antifoaming additive(s) substantially entirely, the fuel composition being nearly or essentially free of such additives and containing for example 2 ppmw or less, preferably 1 ppmw or less, more preferably 0.5 ppmw or less of antifoaming additives.

(All additive concentrations quoted in this specification refer, unless otherwise stated, to active matter concentrations.)

By "antifoaming additive" is meant a reagent, or a formulation containing such a reagent, which is suitable for inclusion in a fuel composition (such as a diesel fuel composition) and which has the effect of improving the antifoaming properties of that composition for instance in the manner described below. Known silicone based antifoaming fuel additives include the polyether-modified polysiloxanes commercially available as TEGOPREN™ 5851 (ex Goldschmidt), Q 25907 (ex Dow Corning), SAG™ TP-325 (ex OSi) and RHODORSIL™ (ex Rhone Poulenc).

The antifoaming properties of a fuel composition may be assessed with reference to the volume of foam generated when a sample of the composition is filled into an appropriate vessel, and/or to the rate at which the thus generated foam dissipates. Standard test procedures may be used to assess such parameters, such as the Association Français de Normalisation (AFNOR) procedure NF M 07-075 and/or tests based on such procedures, for example the method used in Examples 3 and 4 below.

Thus, an improvement in antifoaming properties may be manifested by a reduction in foam volume, and/or a reduction in foam dissipation time or foam collapse time (which equates to an increase in foam dissipation rate), when the fuel composition is tested in this way. Preferably the Fischer-Tropsch derived fuel is used in the fuel composition in an amount sufficient to achieve a reduction in foam volume of at least 2%, more preferably at least 4%, yet more preferably at least 6 or 10%, most preferably at least 12 or 15 or 20%, even up to 22 or 25% or more, of that generated under the same test conditions by the same fuel composition but without, or with less of (suitably with 5% v/v or less of, more suitably with 1% v/v or less of), the Fischer-Tropsch derived fuel present, and/or of that generated by the same fuel composition under the same test conditions prior to replacement, in accordance with the present invention, of some or all of its antifoaming additive(s) by the Fischer-Tropsch derived fuel.

Preferably the Fischer-Tropsch derived fuel is used in an amount sufficient to achieve a reduction in foam dissipation time of at least 15%, more preferably at least 18%, most preferably at least 20 or 30 or 40%, even up to 50 or 60 or 70 or 75% or more, of that exhibited under the same test conditions by the same fuel composition but without, or with less of (suitably with 5% v/v or less of, more suitably with 1% v/v or less of), the Fischer-Tropsch derived fuel present, and/or of that exhibited by the same fuel composition under the same test conditions prior to replacement, in accordance with the present invention, of some or all of its antifoaming additive(s) by the Fischer-Tropsch derived fuel.

Preferably it is used in an amount sufficient to achieve a foam volume of 105 ml or less, more preferably 100 ml or 90 ml or less, when a 100 ml sample of the resultant fuel composition is tested according to the Association Français de Normalisation (AFNOR) procedure NF M 07-075 or a test based on that procedures, for instance as in Examples 3 and 4 below. Preferably it is used in an amount sufficient to achieve, under the same test conditions, a foam dissipation time of 50 seconds or less, more preferably 40 or 35 seconds or less, yet more preferably 30 or 25 or 20 or 15 seconds or less.

The Fischer-Tropsch derived fuel may be used to reduce the concentration, in the fuel composition, of silicon containing additives generally, to 10 ppmw or less, preferably 5 ppmw or less, more preferably 4 ppmw or less, yet more preferably 3 or 2 ppmw or less. Again, it is suitably used to replace such silicon containing additives substantially entirely, the fuel composition being nearly or essentially free of such additives and containing for example 1 ppmw or less, preferably 0.8 ppmw or less, more preferably 0.5 or even 0.1 ppmw or less of silicon containing additives. Most preferably the fuel composition will contain no (ie, 0% w/w) silicon containing additives, in particular silicon containing antifoaming additives.

According to the present invention, the Fischer-Tropsch derived fuel may be a gas oil, a naphtha fuel or a kerosene fuel. It will suitably be in liquid form under ambient conditions.

The fuel composition may be an automotive fuel composition, more preferably for use in an internal combustion engine, yet more preferably a diesel fuel composition.

Alternatively the fuel composition may be for use in a fuel processing system, for example a fuel reformer such as may be used to produce hydrogen from hydrocarbons for instance for fuel cells, or to produce "syngas" (carbon monoxide and hydrogen) for use in a range of different applications.

In practicing the present invention, the fuel composition may, in order to achieve the desired purpose(s), consist essentially of a Fischer-Tropsch derived fuel—in other words it may contain a major proportion (by which is meant preferably 99% v/v or more of the fuel composition, more preferably 99.5% v/v or more, most preferably 99.8% v/v or more, even up to 100%), of the Fischer-Tropsch derived fuel, optionally with a minor proportion of one or more suitable fuel additives such as are known in the art (though ideally without antifoaming additives), but with no other fuel components present.

Alternatively, the fuel composition may contain, in addition to a Fischer-Tropsch derived fuel, one or more other fuel components of conventional type, for instance diesel fuel components such as a diesel base fuel (which may itself comprise a blend of two or more diesel fuel components).

The concentration of the Fischer-Tropsch derived fuel in the composition of the Fischer-Tropsch derived fuel in the composition will be chosen to achieve the desired level of silicon, and may also be influenced by other properties (for example density, boiling point ranges and/or antifoaming performance) required of the overall composition.

The concentration of the Fischer-Tropsch derived fuel in the composition is preferably 15% v/v or greater, more preferably 20% or 25% v/v or greater, still more preferably 30% or 40% or 50% v/v or greater. It may be up to 40% or 50% or 60% or 70% or 80% or 90% or 95% or 98% v/v of the overall composition. Suitable concentrations might lie, for instance, from 20 to 90% v/v or from 25 to 80% v/v or from 25 to 50% v/v or from 30 to either 70 or 60 or 50% v/v.

Any additional fuel component(s) in the composition may be fuels of conventional type. For use in a diesel fuel composition, for example, typical diesel fuel components may comprise liquid hydrocarbon middle distillate fuel oils, for instance petroleum derived gas oils. They may be organically or synthetically derived, although not Fischer-Tropsch derived. Such fuels will typically have boiling points within the usual diesel range of 150 to 400° C., depending on grade and use.

Such fuel components, and ideally also the overall fuel composition, are preferably low or ultra low sulphur fuels, or sulphur free fuels, for instance containing at most 500 ppmw, preferably no more than 350 ppmw, most preferably no more than 100 or 50 ppmw, or even 10 ppmw or less, of sulphur. They are preferably free or substantially free of, or contain only low levels of, materials capable of acting as catalyst poisons in the context of their intended use.

When used in a diesel composition, fuel components will typically have densities from 0.75 to 0.9 g/cm$^3$, preferably from 0.8 to 0.86 g/cm$^3$, at 15° C. (eg, ASTM D4502 or IP 365) and cetane numbers (ASTM D613) of from 35 to 80, more preferably from 40 to 75. They will typically have initial boiling points in the range 150 to 230° C. and final boiling points in the range 290 to 400° C. Their kinematic viscosity at 40° C. (ASTM D445) might suitably be from 1.5 to 4.5 centistokes (mm$^2$/s).

Where the Fischer-Tropsch derived fuel is a gas oil, it is preferably suitable for use as a diesel fuel. Its components (or the majority, for instance 95% w/w or greater, thereof) should therefore have boiling points within the typical diesel fuel ("gas oil") range, ie, from about 150 to 400° C. or from 170 to 370° C. It will suitably have a 90% w/w distillation temperature of from 300 to 370° C.

By "Fischer-Tropsch derived" is meant that the fuel is, or derives from, a synthesis product of a Fischer-Tropsch condensation process. The Fischer-Tropsch reaction converts carbon monoxide and hydrogen into longer chain, usually paraffinic, hydrocarbons:

$$n(CO+2H_2)=(-CH_2-)_n+nH_2O+\text{heat},$$

in the presence of an appropriate catalyst and typically at elevated temperatures (eg, 125 to 300° C., preferably 175 to 250° C.) and/or pressures (eg, 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane.

Gas oil, naphtha and kerosene products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, eg, GB-B-2077289 and EP-A-0147873) and/or hydroisomerization which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerization or hydrocracking (this hydrogenates the olefinic and oxygen-containing components), and then at least part of the resultant product is hydroconverted under conditions such that hydrocracking and isomerization occur to yield a substantially paraffinic hydrocarbon fuel. The desired gas oil fraction(s) may subsequently be isolated for instance by distillation.

Other post-synthesis treatments, such as polymerization, alkylation, distillation, cracking-decarboxylation, isomerization and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al ("The Shell Middle Distillate Synthesis Process", paper delivered at the 5$^{th}$ Synfuels Worldwide Symposium, Washington D.C., November 1985; see also the November 1989 publication of the same title from Shell International Petroleum Company Ltd, London, UK). This process (also sometimes referred to as the Shell™ "Gas-to-Liquids" or "GtL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions. A version of the SMDS process, utilizing a fixed bed reactor for the catalytic conversion step, is currently in use in Bintulu, Malaysia and its products have been blended with petroleum derived gas oils in commercially available automotive fuels.

Gas oils, naphtha fuels and kerosenes prepared by the SMDS process are commercially available for instance from the Royal Dutch/Shell Group of Companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

Suitably, in accordance with the present invention, a Fischer-Tropsch derived gas oil will consist of at least 70% w/w, preferably at least 80% w/w, more preferably at least 90% w/w, most preferably at least 95% w/w, of paraffinic components, preferably iso- and linear paraffins. The weight ratio of iso-paraffins to normal paraffins will suitably be greater than 0.3 and may be up to 12; suitably it is from 2 to 6. The actual value for this ratio will be determined, in part, by the hydroconversion process used to prepare the gas oil from the Fischer-Tropsch synthesis product. Some cyclic paraffins may also be present.

By virtue of the Fischer-Tropsch process, a Fischer-Tropsch derived fuel has essentially no, or undetectable levels of, sulphur and nitrogen. Compounds containing these heteroatoms tend to act as poisons for Fischer-Tropsch catalysts and are therefore removed from the synthesis gas feed. This can yield additional benefits, in terms of effect on catalyst performance, in fuel compositions prepared in accordance with the present invention.

Further, the Fischer-Tropsch process as usually operated produces no or virtually no aromatic components. The aromatics content of a Fischer-Tropsch derived fuel, suitably determined by ASTM D4629, will typically be below 1% w/w, preferably below 0.5% w/w and more preferably below 0.1% w/w.

Generally speaking, Fischer-Tropsch derived fuels have relatively low levels of polar components, in particular polar surfactants, for instance compared to petroleum derived fuels. It is believed that this contributes to their improved antifoaming and dehazing performance. Such polar components may include for example oxygenates, and sulphur and nitrogen containing compounds. A low level of sulphur in a Fischer-Tropsch derived fuel is generally indicative of low levels of both oxygenates and nitrogen containing compounds, since all are removed by the same treatment processes.

A Fischer-Tropsch derived gas oil useable in the present invention will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably 2.5 to 4.0, more preferably from 2.9 to 3.7, centistokes (mm$^2$/s) at 40° C.; and a sulphur content (ASTM D2622) of 5 ppmw or less, preferably of 2 ppmw or less.

Preferably it is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

Where the Fischer-Tropsch derived fuel is a naphtha fuel, it will be a liquid hydrocarbon middle distillate fuel with a final boiling point of typically up to 220° C. or preferably of 180° C. or less. Its initial boiling point is preferably higher than 25° C., more preferably higher than 35° C. Its components (or the majority, for instance 95% w/w or greater, thereof) are typically hydrocarbons having 5 or more carbon atoms; they are usually paraffinic.

The distillation properties of such a naphtha fuel tend to be comparable to those of gasoline. As with the corresponding gas oils, Fischer-Tropsch derived naphtha fuels tend to be low in undesirable fuel components such as sulphur, nitrogen and aromatics.

In the context of the present invention, a Fischer-Tropsch derived naphtha fuel preferably has a density of from 0.67 to 0.73 g/cm$^3$ at 15° C. and/or a sulphur content of 5 ppmw or less, preferably 2 ppmw or less. It preferably contains 95% w/w or greater of iso- and normal paraffins, preferably from 20 to 98% w/w or greater of normal paraffins. It is preferably the product of a SMDS process, preferred features of which may be as described above in connection with Fischer-Tropsch gas oils.

Where the Fischer-Tropsch derived fuel is a kerosene fuel, it will be a liquid hydrocarbon middle distillate fuel with a distillation range suitably from about 150 to 250° C. or from about 150 to 200° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C. Again, Fischer-Tropsch derived kerosenes tend to be low in undesirable fuel components such as sulphur, nitrogen and aromatics.

A Fischer-Tropsch derived kerosene fuel preferably has a density of from 0.730 to 0.760 g/cm$^3$ at 15° C.—for instance from 0.730 to 0.745 g/cm$^3$ for a narrow-cut fraction and from 0.735 to 0.760 g/cm$^3$ for a full-cut fraction—, and/or a sulphur content of 5 ppmw or less. It is preferably the product of a SMDS process, preferred features of which may be as described above in connection with Fischer-Tropsch gas oils.

When practicing the present invention using a Fischer-Tropsch derived fuel, it is conveniently a gas oil as used in Examples 3 and 4 below, or a naphtha fuel as used in Example 1, or a fuel having the same or a similar effect on catalyst performance and/or the same or a similar density and/or boiling point range.

In accordance with the present invention, more than one Fischer-Tropsch derived fuel of the types described above may be used in a fuel composition.

The present invention may be applicable where the fuel composition is suitable for, and/or intended for, use in any system which can be powered by or otherwise consume a fuel, in particular a diesel fuel, composition. In particular it may be suitable, and/or intended, for use in an internal or external (preferably internal) combustion engine, more particularly for use as an automotive fuel and most particularly for use in an internal combustion engine of the compression ignition (diesel) type. Such a diesel engine may be of the direct injection type, for example of the rotary pump, in-line pump, unit pump, electronic unit injector or common rail type, or of the indirect injection type. It may be a heavy or a light duty diesel engine.

Where the fuel composition is such an automotive diesel fuel composition, it preferably falls within applicable current standard specification(s) such as for example EN 590:99. It suitably has a density from 0.82 to 0.845 g/cm$^3$ at 15° C.; a final boiling point (ASTM D86) of 360° C. or less; a cetane number (ASTM D613) of 51 or greater; a kinematic viscosity (ASTM D445) from 2 to 4.5 centistokes (mm$^2$/s) at 40° C.; a sulphur content (ASTM D2622) of 350 ppmw or less; and/or a total aromatics content (IP 391(mod)) of less than 11.

The fuel composition may be suitable for, and/or intended for, use in a catalytically driven or catalyst containing fuel processing system, for example of the types described above. It may indeed be suitable and/or intended for use in any system involving catalytic modification of a fuel or of fuel-derived products such as combustion products. Its reduced content of, or more preferably lack of, silicon can help to reduce damage to the processor catalysts. There may also be benefits further downstream, in that the products of the catalyst containing system can themselves then contain lower silicon levels—thus, for example, since syngas (which may be produced using a fuel reformer) can be used as a fuel to regenerate certain types of catalyst in vehicle exhaust systems, especially in diesel powered vehicles, the reduced silicon content of syngas produced from a fuel or composition according to the present invention can help to protect the exhaust system catalysts.

Generally speaking, and subject to the desire to reduce the levels of certain additives by using the Fischer-Tropsch derived fuel, in the context of the present invention any fuel component or fuel composition may be additivated (additive containing) or unadditivated (additive free). Such additives may be added at various stages during the production of a fuel composition; in the case of automotive fuels those added to a base fuel at the refinery for example might be selected from anti-static agents, pipeline drag reducers, flow improvers (eg, ethylene/vinyl acetate copolymers or acrylate/maleic anhydride copolymers) and wax anti-settling agents (eg, those commercially available under the Trade Marks "PARAFLOW" (eg, PARAFLOW™ 450, ex Infineum), "OCTEL" (eg, OCTEL™ W 5000, ex Octel) and "DODIFLOW" (eg, DODIFLOW™ v 3958, ex Hoechst).

Thus if the fuel composition contains additives, they will typically although not necessarily be incorporated together with one or more of the constituent fuel components (including the Fischer-Tropsch derived component), whether at or downstream of the refinery. Suitably however the composition will contain only a minor proportion (preferably less than 1% w/w, more preferably less than 0.5% w/w (5000 ppmw) and most preferably less than 0.2% w/w (2000 ppmw)) of any such fuel additives.

Components which may be incorporated in fuel additives, in particular for use in diesel fuels, include lubricity enhancers such as EC 832 and PARADYNE™ 655 (ex Infineum), HITEC™ E580 (ex Ethyl Corporation) and VEKTRON™ 6010 (ex Infineum) and amide based additives such as those available from the Lubrizol Chemical Company, for instance LZ 539 C; ignition improvers (cetane improvers) (eg, 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (eg, that sold commercially by Rhein Chemie, Mannheim, Germany as "RC 4801", a propane-1,2-diol semi-ester of tetrapropenyl succinic acid, or polyhydric alcohol esters of a succinic acid derivative, the succinic acid derivative having on at least one of its alpha carbon atoms an unsubstituted or substituted aliphatic hydrocarbon group containing from 20 to 500 carbon atoms, eg, the pentaerythritol diester of polyisobutylene-substituted succinic acid); corrosion inhibitors; reodorants; anti-wear additives; anti-oxidants (eg, phenolics such as 2,6-di-tert-butylphenol, or phenylenediamines such as N,N'-di-sec-butyl-p-phenylenediamine); and metal deactivators.

A fuel additive may include a detergent, by which is meant an agent (suitably a surfactant) which can act to remove, and/or to prevent the build up of, combustion related deposits within a fuel combustion system, in particular in the fuel injection system of an engine such as in the injector nozzles. Such materials are sometimes referred to as dispersant additives. Examples of known detergents include polyolefin substituted succinimides or succinamides of polyamines, for instance polyisobutylene succinimides or polyisobutylene amine succinamides, aliphatic amines, Mannich bases or reaction products of amines and polyolefin (eg, polyisobutylene) maleic anhydrides. Succinimide dispersant additives are described for example in GB-A-960493, EP-A-0147240, EP-A-0482253, EP-A-0613938, EP-A-0557516 and WO-A-98/42808. Detergent-containing diesel fuel additives are known and commercially available for instance from Infineum (eg, F7661 and F7685), Octel (eg, OMA 4130D) and Lubrizol (eg, the Lz8043 series).

Where, in practising the present invention, the fuel composition contains any additives at all, and in particular when it is a diesel fuel composition, it may be particularly preferred for it to include at least a lubricity enhancer, especially when the fuel or composition has a low (eg, 500 ppmw or less) sulphur content. Any such lubricity enhancer is conveniently present at a concentration from 50 to 1000 ppmw, preferably from 100 to 1000 ppmw, based on the overall fuel or composition.

The (active matter) concentration of any ignition improver present will preferably be 600 ppmw or less, more preferably 500 ppmw or less, conveniently from 300 to 500 ppmw.

Where the fuel composition includes a detergent, typical concentrations lie in the range 20 to 500 ppmw active matter detergent based on the overall composition, more preferably 40 to 500 ppmw, most preferably 40 to 300 ppmw or 100 to 300 ppmw or 150 to 300 ppmw. In the context of the present invention, however, it may be preferred to use lower detergent concentrations, for instance 400 ppmw or less, more preferably 300 ppmw or less, yet more preferably 200 or 100 ppmw or less, most preferably 50 ppmw or 20 ppmw or less, such as from 10 to 100 ppmw or from 10 to 50 ppmw, active matter detergent based on the overall fuel composition. Any detergent additives present are preferably incorporated at levels no higher than, preferably lower than, more preferably 0.8 times or less, yet more preferably 0.5 times or less, their standard recommended single treat rate(s). Still more preferably, the fuel composition contains no detergents, since Fischer-Tropsch derived fuels are known to have detergency properties of their own.

Unless otherwise stated, and again subject to the desire to reduce certain additive levels by using the Fischer-Tropsch derived fuel, the (active matter) concentration of any other type of additive in the overall fuel composition is preferably up to 1% w/w, more preferably in the range from 5 to 1000 ppmw, advantageously from 75 to 300 ppmw, such as from 95 to 150 ppmw.

An additional benefit of reducing fuel silicon levels in accordance with the present invention can be in systems involving fuel combustion, where silicon deposits have been found to accumulate when the systems are run on silicon containing fuels, as described in Example 2 below. Thus, for example, where an automotive vehicle is to be run on a fuel composition prepared in accordance with the present invention, benefits may arise not only in its catalytically driven exhaust aftertreatment system but also upstream in its fuel combustion system.

Thus, in accordance with the present invention, the Fischer-Tropsch derived fuel may be used for the purpose of reducing loss of efficiency of fuel atomization and/or combustion in a fuel consuming system which is running on, or is to be run on, the fuel composition. It may be used for the purpose of reducing build up of deposits, in particular silicon deposits, in a fuel consuming system which is running on, or is to be run on, the fuel composition. In both cases the system preferably is or is part of a fuel combustion system, typically part of an internal combustion engine for an automotive vehicle such as a diesel engine; it may in particular be a fuel injection system within such a combustion system. The deposits in question are likely to build up in its fuel injection system such as in and around the injector nozzles.

"Use" of a Fischer-Tropsch derived fuel for such purposes may involve incorporating it into a fuel composition, typically as a blend (ie, a physical mixture) with one or more other fuel components and/or fuel additives, introducing the composition into the fuel consuming system and/or operating the system using the fuel composition. Alternatively, the use may involve introducing the Fischer-Tropsch derived fuel alone into the system, and suitably also operating the system using it.

Efficiency of fuel atomization and/or combustion in a fuel powered (typically fuel combustion) system may be assessed with reference to the efficiency of fluid flow through the atomization nozzle(s), which may be linked to the degree of nozzle fouling since any deposits accumulated in the nozzle(s) will reduce the area through which fluid can flow and hence the atomization and combustion efficiency. Degree of nozzle fouling may be assessed in a number of ways, for instance visually, by measuring the mass of deposits in a fouled nozzle or by measuring the fluid flow (for instance, fuel flow or more preferably air flow) properties of the fouled nozzle relative to those of the clean nozzle.

An appropriate test might for example determine the degree of nozzle fouling (conveniently in the form of a percentage injector fouling index) under steady state conditions in a suitable engine such as a diesel engine, for instance based on the change in air flow rate through one or more of the fuel injector nozzles as a result of using the fuel composition under test. Conveniently the results are averaged over all of the injector nozzles of the engine. The CEC standard test method F-23-T-00, which involves injector nozzle air flow measurements, may for instance be used to assess engine fouling.

Another suitable method for measuring air flow through fuel injector nozzles is ISO 4010-1977.

The Fischer-Tropsch derived fuel is preferably used in an amount sufficient to achieve a reduction in engine fouling (measured for instance as outlined above) of at least 5%, preferably at least 8%, more preferably at least 10%, most preferably at least 20%, as compared to that caused by running the system (under the same or comparable conditions, and for the same length of time) on the same fuel composition but without, or with less of (suitably with 5% v/v or less of, more suitably 1% v/v or less of), the Fischer-Tropsch derived fuel(s) present, and/or from using the same fuel composition prior to replacement, in accordance with the present invention, of some or all of its antifoaming additive(s) by a Fischer-Tropsch derived fuel.

More preferably, the Fischer-Tropsch derived fuel is used in an amount sufficient to remove, at least partially, combustion related deposits which have built up in an engine's fuel injection system, in particular in the injector nozzles, during a previous period of running using another automotive fuel (typically a fuel composition without, or with less (suitably with 5% v/v or less, more suitably 1% v/v or less), Fischer-Tropsch derived fuel(s) present), and/or using the same fuel composition prior to replacement, in accordance with the present invention, of some or all of its antifoaming additive(s) by a Fischer-Tropsch derived fuel. This concentration is preferably sufficiently low to remove at least 5% of the previously incurred injector deposits (measured for instance as described above), more preferably at least 10%, most preferably at least 15 or 20 or 25%.

Such reductions may be as compared to running the system under the same or comparable conditions, for the same length of time, on the same fuel composition but with a higher (for instance, 100 ppbw or greater, possibly 500 or 1000 ppbw or greater) silicon content, and/or by running the system on the same fuel composition prior to reduction, in accordance with the present invention, of its silicon content.

The removal of combustion related deposits may be achieved by running the engine on the fuel composition of the present invention for instance for the same period of time as that during which the deposits accumulated, or more preferably for 75%, yet more preferably 50% or even 40% or 30%, of the period of deposit accumulation, conveniently under comparable conditions. Ideally at least partial removal of combustion related deposits is achieved by running the engine on the fuel composition of the present invention for five hours or less, preferably for three hours or less, more preferably for two hours or less.

A reduction in fuel atomization and/or combustion efficiency may also be manifested by a loss of power output, and/or by an increase in undesirable emissions, from a system, for instance in a vehicle driven by a combustion engine.

Preferred degrees of reduction in atomization and combustion efficiency may be as described above in connection with nozzle fouling.

Preferably the Fischer-Tropsch derived fuel is used in an amount sufficient to achieve a reduction in fuel atomization and/or combustion efficiency which is at least 2% lower than, more preferably at least 5% or 8% or 10% lower than, that caused over the same time period and under the same test conditions by running the system on a non-Fischer-Tropsch derived fuel, and/or by running the system on the same fuel composition but without, or with less of (suitably with 5% v/v or less of, more suitably 1% v/v or less of), the Fischer-Tropsch derived fuel(s) present, and/or by running the system on the same fuel composition prior to replacement, in accordance with the present invention, of some or all of its antifoaming additive(s) by a Fischer-Tropsch derived fuel. The reduction may again be as compared to that caused over the same time period and under the same test conditions by running the system on a fuel composition with a higher (for instance, 100 ppbw or greater, possibly 500 or 1000 ppbw or greater) silicon content, and/or by running the system on the same fuel composition prior to reduction, in accordance with the present invention, of its silicon content.

Levels of deposits in a fuel consuming system may be assessed for instance using a scanning electron microscope, and/or by X-ray or other spectroscopic analysis of components of the system (in particular fuel injector nozzles), over a period of running the system on the fuel or fuel composition in question.

Preferably the amount of the Fischer-Tropsch derived fuel used in the composition is sufficiently low to achieve a reduction in the level of silicon deposits caused over the same time period and under the same test conditions by running the system on a non-Fischer-Tropsch derived fuel, and/or by running the system on the same fuel composition but without, or with less of (suitably with 5% v/v or less of, more suitably 1% v/v or less of), the Fischer-Tropsch derived fuel(s) present, and/or by running the system on the same fuel composition prior to inclusion, in accordance with the present invention, of the Fischer-Tropsch derived fuel, or of a higher level of Fischer-Tropsch derived fuel(s), for instance to replace some or all of its antifoaming additive(s). Such a reduction may be as compared to that caused over the same time period and under the same test conditions by running the system on the same fuel or composition but with a higher (for instance, 100 ppbw or greater, possibly 500 or 1000 ppbw or greater) silicon content, and/or by running the system on the same fuel or composition prior to reduction, in accordance with the present invention, of its silicon content. Preferably the amount of the Fischer-Tropsch derived fuel used is sufficient to achieve no or only negligible silicon deposits in a fuel injection system running on the fuel composition.

The reduction may be assessed over any appropriate test period, for instance 10 operating hours or more, suitably 100 or 200 or 500 operating hours or more. It may be assessed over the lifetime or expected lifetime of the system, for instance up to 5,000 operating hours for a typical passenger vehicle or up to 50,000 operating hours for a commercial vehicle or a stationary generator.

According to a second aspect of the present invention, there is provided a method of operating a fuel consuming system, which method involves introducing into the system either (i) a fuel composition containing a Fischer-Tropsch derived fuel, or (ii) a product of such a fuel composition, for one or more of the purposes described above in connection with the first aspect of the present invention. Again the system may be one which, like an exhaust aftertreatment system, consumes products of the fuel composition such as its combustion products.

This second aspect of the present invention encompasses a method of operating a machine which is powered by a fuel consuming (in particular fuel combustion) system, especially a vehicle which is driven by a combustion engine, for instance a diesel powered vehicle.

A third aspect of the present invention provides a method for the preparation of a fuel composition, which method involves blending a Fischer-Tropsch derived fuel with one or more other fuel components and/or with one or more fuel additives, for one or more of the purposes described in connection with the first and second aspects of the present invention, either in relation to the properties of the fuel composition and/or to its effect on a system into which the composition is or is intended to be introduced.

Preferred features of the second and third aspects of the present invention, in particular as regards the degree of reduction in fuel silicon levels, how it is achieved, the nature and concentration of the Fischer-Tropsch derived fuel and of any other fuel components and additives present in the fuel composition, and as regards the extent to which any intended purpose is achieved, may be as described above in connection with the first aspect of the present invention.

A fourth aspect of the present invention provides a method of operating a fuel consuming system (including a system which consumes fuel products), the method involving introducing into the system, and preferably running the system on, a fuel composition prepared by putting any of the first to the third aspects of the present invention into effect.

The present invention will be further understood from the following examples, which illustrate the effects of fuel silicon content on catalytically driven systems, and the use of Fischer-Tropsch derived fuels to reduce silicon levels.

EXAMPLE 1

This example assessed the effects of fuel silicon levels, in particular due to the presence of a silicone based antifoaming additive, on catalyst efficiency in a catalytic partial oxidation (CPO) reactor. Such systems can be used to oxidize a fuel feed into carbon monoxide and hydrogen ("syngas") for instance to produce hydrogen for use in fuel cells or for use as a feed for other chemical syntheses or conversion processes. The reactor in this case used a platinum group catalyst.

The additive tested was siloxane based and contained 11% w/w silicon. Its active ingredient comprised a polysilicone backbone modified with polyether side chains; it was similar to the commercially available product SAG TP 325 (OSi Specialities). This was added at various levels to a Fischer-Tropsch (SMDS) derived naphtha fuel F1 sourced from the Royal Dutch/Shell Group of Companies and having the properties listed in Table A.

TABLE A

| Fuel property | Test method | F1 |
|---|---|---|
| Density @ 15° C. (g/cm$^3$) | IP 365/ASTM D4052 | 0.6786 |
| Distillation | IP 123/ASTM D86 | |
| IBP (° C.) | | 33.7 |
| 10% | | 61.4 |
| 20% | | 71.3 |
| 30% | | 79.7 |
| 40% | | 87.2 |
| 50% | | 94.8 |
| 60% | | 102 |
| 70% | | 109.4 |
| 80% | | 116.8 |
| 90% | | 124.6 |
| 95% | | 129.6 |
| FBP | | 138.5 |
| Carbon (average no. of atoms per molecule) | Gas chromatography | 6.57 |
| Hydrogen (average no. of atoms per molecule) | Gas chromatography | 15.12 |
| Oxygen (average no. of atoms per molecule) | Gas chromatography | 0 |
| Paraffins (% v/v): | Gas chromatography | 74.11 |
| Iso- | | 25.14 |
| i- + n- | | 99.25 |
| Olefins (% v/v) | Gas chromatography | 0 |

TABLE A-continued

| Fuel property | Test method | F1 |
|---|---|---|
| Naphthenes (% v/v) | Gas chromatography | 0.71 |
| HPLC aromatics (% w/w) | IP 391 (mod) | 0.01 |
| Oxygenates (% w/w) | | 0 |
| Sulphur (WDXRF) (ppmw) | ASTM D2622 | <5 |
| Enthalpy of combustion (MJ/kg) (gas) | | −44.953 |
| Enthalpy of combustion (MJ/kg) (liqu) | | −44.591 |

The additive (A1) was dissolved in the solvent methyl tert-butyl ether (MTBE) since it does not readily dissolve directly in naphtha fuels.

The CPO was operated at a relatively high space velocity, using a mixture of steam, oxygen and the relevant fuel as its feed stream, with a steam:carbon ratio of 1.0 and the oxygen: carbon ratio adjusted in each case (between about 0.4 and 0.5) to give the maximum yield of syngas for the particular fuel under test. Each run lasted approximately 5-6 hours, except that using the naphtha fuel F1 alone (experiment 1.2) which lasted 30 hours.

The deactivation rate of the CPO catalyst was assessed by measuring the syngas yield (moles of syngas produced per mole of fuel feed) at the start and end of each run and calculating the loss of yield over that period.

Two "blank" experiments were run initially, one using only MTBE as the reactor feed and another only the fuel F1. These revealed a very low catalyst deactivation rate, yield loss per hour about 0.005.

CPO operation was then tested using as the feeds three samples of the additive/MTBE-spiked naphtha fuel, having silicon contents of 500, 1000 and 5000 ppbw respectively. The normal recommended treat rate for the additive is from 5 to 10 mg/kg, corresponding to a fuel silicon content of the order of 1000 ppbw.

CPO operation was also tested using as feeds three different samples of 1-hexene, H1 to H3, having respective silicon contents of 0, 5500 and 14000 ppbw.

The effects on catalyst deactivation rate, in all of these runs, are summarized in Table 1.

TABLE 1

| Experiment no. | CPO feed | Silicon content of feed (ppbw) | Catalyst deactivation rate (yield loss/hr) |
|---|---|---|---|
| 1.1 | MTBE | 0 | 0.005 |
| 1.2 | F1 | 0 | 0.005 |
| 1.3 | F1 + MTBE + A1 | 500 | 0.073 |
| 1.4 | F1 + MTBE + A1 | 1000 | 0.09 |
| 1.5 | F1 + MTBE + A1 | 5000 | 0.52 |
| 1.6 | H1 | 0 | ~0 |
| 1.7 | H2 | 5500 | 0.55 |
| 1.8 | H3 | 14000 | 1.4 |

These data show a clear (in practice, linear) correlation between the silicon content of the feed and the catalyst deactivation rate, the latter being approximately equal to 0.0001 times the silicon content in ppbw. It appears therefore that silicon can be significantly detrimental to catalyst function. The silicon is believed, although we do not wish to be bound by this theory, to block catalytically active sites, probably chemically. A similar effect has been found in systems containing catalysts of other types, for instance silver based catalysts, when silicon has been present in the feed stream. Silicon could therefore be detrimental to many types of catalyst.

The use of exhaust aftertreatment catalysts in diesel powered and other automotive vehicles is likely to increase as vehicle emissions standards become more stringent. Thus, although silicon may not currently be a concern in automotive diesel fuels (active catalyst levels typically being higher in any case in an exhaust treatment system than in a fuel reformer), its detrimental effect on catalyst efficiency may become more significant in the future. There may therefore in the future be a need for automotive diesel fuels with reduced silicon contents, preferably silicon free. Clearly in other fuel consuming systems involving catalysts—fuel reformers such as the CPO being but one example—it would also be desirable, in view of these experimental results, to reduce or preferably eliminate silicon contents.

EXAMPLE 2

The potential effect of silicon containing additives in diesel fuel compositions was also observed in diesel engines.

The fuel injectors of a Volvo™ D16A diesel engine were examined under a scanning electron microscope (SEM) following a period of normal use running on standard commercially available (UK) diesel fuels. Such fuels are highly likely to contain silicone based antifoaming additives.

Silicon deposits were detected in the small holes of the fuel injectors, as confirmed both by SEM photographs and also by X-ray analysis of the injector surfaces performed at the same time. The basic constitution of the injector metal, in regions unaffected by fuel contact, showed a silicon content of 0.34% w/w. At the outer end of the nozzle spray hole, in contrast, the silicon content was 8.16% w/w, indicating significant deposits of the element which at these levels are postulated to derive from fuel additives passing through the injectors as well as simple environmental pollution (dust, sand and the like).

It is possible that such deposits could contribute, certainly over an extended period of use, to a reduction in fuel atomization and/or combustion efficiency. Again, as the trend towards increasingly smaller fuel injection holes continues in engines of this type, the build up of such deposits may become a more significant problem. Thus, particularly in automotive diesel engines but also in any fuel powered systems comprising fuel injection systems, it would be desirable to be able to use fuels with reduced silicon contents, preferably silicon free. Examples 3 and 4 below demonstrate that such fuels may be achieved using a Fischer-Tropsch derived fuel at least partially to replace conventional silicon containing additives.

EXAMPLE 3

A Fischer-Tropsch (SMDS) derived gas oil fuel F2 was blended in various proportions with a conventional petroleum derived ultra low sulphur diesel fuel F3, and the antifoaming properties assessed for the blends as well as for the neat fuels F2 and F3.

Both fuels were commercially available and were sourced from the Royal Dutch/Shell Group of Companies. Their properties are shown in Table B.

TABLE B

| Fuel property | Test method | F2 | F3 |
|---|---|---|---|
| Density @ 15° C. ($g/cm^3$) | IP 365/ASTM D4052 | 0.7852 | 0.8328 |
| Distillation | IP 123/ASTM D86 | | |
| IBP (° C.) | | 211.5 | 169.0 |
| 10% | | 249.0 | 209.0 |
| 20% | | 262.0 | 231.0 |

TABLE B-continued

| Fuel property | Test method | F2 | F3 |
|---|---|---|---|
| 30% | | 274.0 | 249.0 |
| 40% | | 286.0 | 262.5 |
| 50% | | 298.0 | 274.5 |
| 60% | | 307.5 | 285.5 |
| 70% | | 317.0 | 296.5 |
| 80% | | 326.5 | 309.0 |
| 90% | | 339.0 | 327.0 |
| 95% | | 349.0 | 342.0 |
| FBP | | 354.5 | 357.0 |
| Cetane number | ASTM D613 | >74.8 | 54.8 |
| Cetane index | IP 364/84/ASTM D976 | 77.2 | 54.6 |
| Kinematic viscosity @ 40° C. (centistokes) ($mm^2/s$) | IP 71/ASTM D445 | 3.606 | |
| Cloud point (° C.) | IP 219 | +2 | −7 |
| Sulphur (WDXRF) (ppmw) | ASTM D2622 | <5 | 38 |
| HPLC aromatics (% w/w): | IP 391 (mod) | | |
| Mono | | 0.1 | 19 |
| Di | | <0.1 | 3.3 |
| Tri | | <0.1 | 0.5 |
| Total | | 0.1 | 22.8 |

The gas oil F2 had been obtained from a Fischer-Tropsch (SMDS) synthesis product via a two-stage hydroconversion process analogous to that described in EP-A-0583836.

Antifoaming performance for each fuel or blend was assessed using a test procedure based on the Association Français de Normalisation (AFNOR) procedure NF M 07-075. A 100 ml sample of the fuel or blend was pumped under controlled conditions into a measuring cylinder, as laid down in NF M 07-075, and the volume of foam produced was measured.

The foam was then allowed to collapse and its dissipation time recorded.

The results are shown in Table 2.

TABLE 2

| Experiment no. | Volume % F2 | Volume % F3 | Foam volume (ml) | Dissipation time (s) |
|---|---|---|---|---|
| 3.1 | 0 (ie, fuel F3 alone) | 100 | 107 | 41 |
| 3.2 | 10 | 90 | 108 | 41 |
| 3.3 | 30 | 70 | 104 | 33 |
| 3.4 | 50 | 50 | 102 | 33 |
| 3.5 | 70 | 30 | 94 | 25 |
| 3.6 | 90 | 10 | 84 | 22 |
| 3.7 | 100 | 0 (ie, fuel F2 alone) | 82 | 14 |

It can be seen that incorporation of the Fischer-Tropsch derived fuel F2 gives a significant antifoaming benefit compared to the performance of the petroleum derived diesel fuel F3 alone, in particular in terms of reduced foam dissipation times. The antifoaming performance of F2 is markedly superior to that of F3.

EXAMPLE 4

The antifoaming performance of F2 was compared with that of other commercially available, petroleum derived diesel fuels F4 to F8. The properties of these fuels are summarized in Table C; they were selected to represent a range of different diesel fuel qualities. F4, F5, F6 and F8 were sourced via the Royal Dutch/Shell Group of Companies. F7 was sourced in Argentina to correspond to that country's typical production quality.

TABLE C

| Fuel property | Test method | F4 | F5 | F6 | F7 | F8 |
|---|---|---|---|---|---|---|
| Geographical origin | | Germany | France | Turkey | Argentina | Germany |
| Density @ 15° C. ($g/cm^3$) | IP 365/ASTM D4052 | 0.8403 | 0.8348 | 0.8334 | 0.8377 | 0.8477 |
| Distillation | IP 123/ASTM D86 | | | | | |
| IBP (° C.) | | 180.0 | 173.5 | 188.0 | 184.5 | 198.0 |
| 10% | | 220.0 | 203.1 | 221.5 | 222.0 | 238.5 |
| 20% | | 237.0 | 221.8 | 237.5 | 240.5 | 254.5 |
| 30% | | 251.5 | 239.6 | 250.5 | 259.0 | 266.0 |
| 40% | | 264.0 | 255.3 | 263.5 | 275.0 | 276.0 |
| 50% | | 276.0 | 270.2 | 275.5 | 290.5 | 286.0 |
| 60% | | 288.0 | 284.6 | 288.5 | 305.5 | 296.5 |
| 70% | | 301.0 | 300.5 | 301.0 | 321.0 | 308.5 |
| 80% | | 316.5 | 318.6 | 316.5 | 339.0 | 323.5 |
| 90% | | 338.0 | 340.9 | 335.5 | 363.5 | 346.0 |
| 95% | | 355.0 | 359.9 | 351.0 | 383.5 | 364.5 |
| FBP | | 364.5 | 367.4 | 362.0 | 388.0 | 377.0 |
| Cetane number | ASTM D613 | 52.9 | | 55.5 | 58.5 | 51.1 |
| Cetane index | IP 364/84 | 52.3 | 53.0 | 54.6 | 55.8 | 51.7 |
| Kinematic viscosity @ 40° C. (centistokes) ($mm^2/s$) | IP 71/ASTM D445 | 3.020 | 2.660 | 3.2 | 3.9 | 3.608 |
| Cloud point (° C.) | IP 219 | −9 | | −4 | 4 | 0 |
| Sulphur (WDXRF) (ppmw) | ASTM D2622 | 280 | 269 | 4200 | 479 | 412 |

The antifoaming performance of each of these fuels was tested in the same way as in Example 3, and the performance of F2 also re-tested. The results are shown in Table 3.

TABLE 3

| Experiment no. | Fuel | Foam volume (ml) | Dissipation time (s) |
|---|---|---|---|
| 4.1 | F2 | 81 | 13 |
| 4.2 | F3 | 107 | 41 |
| 4.3 | F4 | 111 | 59 |
| 4.4 | F5 | 109 | 45 |
| 4.5 | F6 | 105 | 27 |
| 4.6 | F7 | 88 | 58 |
| 4.7 | F8 | 87 | 60 |

The Fischer-Tropsch derived fuel F2 clearly out-performs all the other commercially available petroleum derived diesel fuels in the context of antifoaming properties, both in terms of initial foam volumes and more particularly foam dissipation rates. Moreover Example 3 showed that the incorporation of as little as 30% v/v of F2 into a petroleum derived diesel base fuel can lead to a significant improvement in the antifoaming performance of the blend compared to that of the base fuel alone.

Thus, in accordance with the present invention, a Fischer-Tropsch derived fuel component may be used at least partly to replace a conventional antifoaming additive, such as a silicone based additive, in a diesel fuel composition. This potentially makes possible compositions which are completely free of antifoaming agents and yet still have acceptable overall antifoaming performance, in turn allowing fuel compositions with reduced if not zero or negligible silicon contents, with the benefits explained in connection with Examples 1 and 2 above.

We claim:

1. A method for reducing a catalyst yield loss incurred by a fuel consuming system comprising a catalytically driven or catalyst containing system during consumption of a fuel composition, the method comprising:

providing to the fuel consuming system a liquid hydrocarbon fuel composition comprising a hydrocarbon base, 1000 ppbw or less of silicon, and a quantity of a Fischer-Tropsch derived liquid hydrocarbon fuel;

consuming the liquid hydrocarbon fuel composition in the fuel consuming system under consuming conditions, thereby reducing the catalyst yield loss by at least 15% compared to a higher catalyst yield loss observed when consuming an analogous non-Fischer-Tropsch derived liquid hydrocarbon fuel composition under the same consuming conditions.

2. The method of claim 1 further comprising reducing the catalyst yield loss by at least 25% compared to the higher catalyst yield loss observed when consuming an analogous non-Fischer-Tropsch derived liquid hydrocarbon fuel composition under the same consuming conditions.

3. The method of claim 1 further comprising producing no more than a 10% reduction in catalyst efficiency.

4. The method of claim 1 wherein the liquid hydrocarbon fuel composition comprises an analogous non-Fischer-Tropsch derived liquid hydrocarbon fuel composition.

5. The method of claim 1 wherein the fuel consuming system is a fuel reformer.

6. The method of claim 1 wherein the fuel consuming system is a combustion engine comprising a catalyst containing exhaust aftertreatment system.

7. A method for reducing a catalyst yield loss incurred by a fuel consuming system comprising a catalytically driven or catalyst containing system during consumption of a fuel composition, the method comprising:

providing to the fuel consuming system a liquid hydrocarbon fuel composition comprising a hydrocarbon base, 1000 ppbw or less of silicon, and at least 15 v/v% of a Fischer-Tropsch derived liquid hydrocarbon fuel;

consuming the liquid hydrocarbon fuel composition in the system under consuming conditions, thereby reducing the catalyst yield loss compared to a higher catalyst yield loss observed when consuming an analogous non-Fischer-Tropsch derived liquid hydrocarbon fuel composition under the same consuming conditions.

8. The method of claim 7 wherein the fuel consuming system is a fuel reformer.

9. The method of claim 7 wherein the fuel consuming system is a combustion engine comprising a catalyst containing exhaust aftertreatment system.

10. A method for reducing a catalyst yield loss incurred by a fuel consuming system comprising a catalytically driven or catalyst containing system during consumption of a fuel composition, the method comprising:

providing to the fuel consuming system a liquid hydrocarbon fuel composition comprising a hydrocarbon base, 1000 ppbw or less of silicon, and at least 30 v/v % of a Fischer-Tropsch derived liquid hydrocarbon fuel composition;

consuming the liquid hydrocarbon fuel composition is the system under consuming conditions, thereby reducing the catalyst yield loss compared to a higher catalyst yield loss observed when consuming an analogous non-Fischer-Tropsch derived liquid hydrocarbon fuel composition under the same consuming conditions.

11. The method of claim 10 wherein the fuel consuming system is a fuel reformer.

12. The method of claim 10 wherein the fuel consuming system is an engine a combustion engine comprising a catalyst containing exhaust aftertreatment system.

13. A method for reducing engine fouling incurred by a fuel consuming system during consumption of a fuel composition, the method comprising:

providing to the fuel consuming system a liquid hydrocarbon fuel composition comprising a hydrocarbon base, 1000 ppbw or less of silicon, and a quantity of a Fischer-Tropsch derived liquid hydrocarbon fuel composition;

consuming the liquid hydrocarbon fuel composition in the fuel consuming system under consuming conditions, thereby reducing the engine fouling by at least 5% compared to a higher amount of engine fouling produced combusting an analogous non-Fischer-Tropsch derived liquid hydrocarbon fuel composition over the same time under the same conditions.

14. The method of claim 13 wherein the engine is a diesel engine, and engine fouling is measured as a change in air flow rate through one or more fuel injector nozzles of the engine.

15. The method of claim 13 comprising reducing the engine fouling by at least 10% compared to a higher amount of engine fouling produced combusting an analogous non-Fischer-Tropsch derived liquid hydrocarbon fuel composition over the same time under the same conditions.

16. The method of claim 13 comprising reducing the engine fouling by at least 20% compared to a higher amount of engine fouling produced combusting an analogous non-Fischer-Tropsch derived liquid hydrocarbon fuel composition over the same time under the same conditions.

17. The method of claim 13 wherein quantity of the Fischer-Tropsch derived liquid hydrocarbon fuel composition is 15 v/v. % or more.

18. The method of claim 13 wherein quantity of the Fischer-Tropsch derived liquid hydrocarbon fuel composition is 30 v/v. % or more.

19. A method for reducing engine fouling incurred by a fuel consuming system during consumption of a fuel composition, the method comprising:

providing to the fuel consuming system a liquid hydrocarbon fuel composition comprising a hydrocarbon base, 1000 ppbw or less of silicon, and 15 v/v % or more of a Fischer-Tropsch derived liquid hydrocarbon fuel composition;

consuming the liquid hydrocarbon fuel composition in the system under consuming conditions, thereby reducing the engine fouling.

20. The method of claim 19 wherein the engine is a diesel engine, and engine fouling is measured as a change in air flow rate through one or more fuel injector nozzles of the engine.

21. A method for reducing engine fouling incurred by a fuel consuming system during consumption of a fuel composition, the method comprising:

providing to the fuel consuming system a liquid hydrocarbon fuel composition comprising a hydrocarbon base, 1000 ppbw or less of silicon, and 30 v/v % or more of a Fischer-Tropsch derived liquid hydrocarbon fuel composition;

consuming the liquid hydrocarbon fuel composition in the system under consuming conditions, thereby reducing the engine fouling.

22. The method of claim 21 wherein the engine is a diesel engine, and engine fouling is measured as a change in air flow rate through one or more fuel injector nozzles of the engine.

23. A method for reducing a foam dissipation time of a fuel composition measured under foam dissipation conditions, the method comprising:

providing the fuel composition exhibiting a first foam dissipation time;

blending with the fuel composition a sufficient quantity of an analogous Fischer-Tropsch derived liquid hydrocarbon fuel composition comprising 1000 ppbw or less of silicon to reduce the first foam dissipation time by at least 15%.

24. The method of claim 23 further comprising feeding the liquid hydrocarbon fuel composition to a fuel consuming system.

25. The method of claim 24 wherein the fuel consuming system is a fuel reformer.

26. The method of claim 24 wherein the fuel consuming system is an engine.

27. A method for reducing a foam dissipation time of a fuel composition measured under foam dissipation conditions, the method comprising:

providing the fuel composition exhibiting a first foam dissipation time;

blending with the fuel composition a sufficient quantity of an analogous Fischer-Tropsch derived liquid hydrocarbon fuel composition comprising 1000 ppbw or less of silicon to reduce the foam dissipation time of the fuel composition to 50 seconds or less.

28. The method of claim 27 further comprising feeding the liquid hydrocarbon fuel composition to a fuel consuming system.

29. The method of claim 28 wherein the fuel consuming system is a fuel reformer.

30. The method of claim 28 wherein the fuel consuming system is a combustion engine.

* * * * *